US007555833B2

(12) United States Patent
Wang et al.

(10) Patent No.: US 7,555,833 B2
(45) Date of Patent: Jul. 7, 2009

(54) SYSTEM FOR PROGRAMMABLE SELF-PIERCING RIVETING

(75) Inventors: Pei-Chung Wang, Troy, MI (US); Peter C. Sun, Rochester Hills, MI (US); Robin Stevenson, Bloomfield, MI (US); Charles W. Wampler, II, Birmingham, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 655 days.

(21) Appl. No.: 11/106,103

(22) Filed: Apr. 14, 2005

(65) Prior Publication Data

US 2006/0230609 A1 Oct. 19, 2006

(51) Int. Cl.
*B23P 19/00* (2006.01)

(52) U.S. Cl. ..... 29/798; 29/716

(58) Field of Classification Search ..... 29/798, 29/703, 243.53, 525.06, 716, 710, 512
See application file for complete search history.

(56) References Cited

U.S. PATENT DOCUMENTS

| | | | | |
|---|---|---|---|---|
| 4,218,953 | A | 8/1980 | Haytayan | 219/87 |
| 5,390,407 | A * | 2/1995 | Musil | 29/512 |
| 6,263,560 | B1 | 7/2001 | Edwards | 219/86.25 |
| 6,429,397 | B1 | 8/2002 | Sun et al. | 29/798 |
| 6,621,036 | B2 | 9/2003 | Sun et al. | 411/29 |
| 2004/0025313 | A1 * | 2/2004 | Dowell et al. | 29/243.53 |

* cited by examiner

*Primary Examiner*—John C Hong

(57) ABSTRACT

A system and method for self-piercing riveting including an alignment mechanism comprising laser diodes and sensors for facilitating alignment of a rivet gun and a back-up located on opposite sides of sheet metal parts to be joined, and an oscillation piercing technique for reducing force loads on structures, particularly robotic structures, carrying the rivet gun and the back-up.

15 Claims, 3 Drawing Sheets

SYSTEM FOR PROGRAMMABLE SELF-PIERCING RIVETING

TECHNICAL FIELD

The present invention relates to systems and methods for self-piercing riveting. More specifically, the present invention concerns a system and method for self-piercing riveting including an alignment mechanism comprising laser diodes and sensors for facilitating alignment of a rivet gun and a back-up located on opposite sides of parts to be joined, and an oscillation piercing technique for reducing force loads on structures, particularly robotic structures, carrying the rivet gun and the back-up.

BACKGROUND OF THE INVENTION

Self-piercing riveting (SPR) is a well-known technique used in vehicle assembly as an alternative to resistance spot welding in applications or locations where welding may be difficult or even impossible to accomplish. In programmable pogo SPR, a rivet gun and a die move together, with one being substantially directly opposite the other, over opposite surfaces of two aligned sheet metal parts to a series of rivet locations. At each such location, a rivet is driven through the parts by the rivet gun, and the projecting shank or end of the driven rivet is shaped by the die. The rivet pierces or creates its own hole through the parts as it is driven. This is in contrast to other prior art riveting techniques in which the rivet is driven through a pre-drilled, pre-punched, or otherwise pre-existing hole. As a result of the SPR process, the parts are securely fastened together by the rivet's head on one side, and by the shape formed at the end of the rivet's projecting shank on the other side.

Unfortunately, this process requires the application of substantial force, typically between 30 kN and 50 kN depending on such factors as the material and thickness of the parts, to cause the rivet to properly penetrate fully through the parts. Such forces, in turn, necessitate large and stiff C-frame support structures for carrying the rivet gun and die, especially if a long reach is required. As a result, these C-frame support structures are often too heavy for use in robotic applications.

Due to these and other problems and limitations in the prior art, an improved self-piercing riveting system or method is needed.

SUMMARY OF THE INVENTION

The present invention overcomes the above-described and other problems and disadvantages in the prior art by providing a system and method for improved programmable pogo self-piercing riveting which is better suited for use in such applications as vehicle assembly, particularly robotic applications in vehicle assembly.

The system broadly comprises a rivet gun including a punch; a movable back-up including a plurality of dies; and an alignment subsystem. The rivet gun contacts a first outward side of aligned first and second sheet metal parts, and, using the punch, drives the rivet through the parts. The back-up positions one of the plurality of dies to contact a second outward side of the parts at a location which is substantially directly opposite the contact point of the rivet gun, and both provides a support to facilitate the rivet gun driving the rivet and shapes the projecting end of the fully-penetrated rivet to securely fasten the parts together. The availability of multiple dies increases accessibility and efficiency.

The alignment subsystem facilitates aligning the rivet gun and back-up opposingly on the outward sides of the parts. The alignment subsystem includes first and second laser-emitting diodes and a plurality of sensors. The first diode is coupled with the rivet gun, and the second diode is coupled with the back-up. The plurality of sensors detect the emissions of the diodes, and, based thereon, adjust or cause to be adjusted, as appropriate, the position of either or both of the rivet gun or the back-up so as to achieve better alignment therebetween.

The present invention employs an oscillation piercing technique wherein the punch is driven in an oscillating manner to effectively hammer the rivet into and through the parts. In the prior art, a single forceful blow or a pressing action is used to drive the rivet. The hammering action of the present invention, however, significantly reduces the amount of force transmitted to the structures supporting the rivet gun and back-up, and thereby allows for the use of robots in applications where they could not, as a practical matter, be used previously.

Thus, it will be understood and appreciated that the present invention provides a number of advantages over the prior art, including, for example, improving the robustness of the SPR process, increasing the flexibility of product designs that rely on the SPR process for assembly, and shortening the cycle time of the SPR process. This is accomplished in part by the alignment subsystem which facilitates efficiently and consistently achieving correct alignment of the rivet gun and the back-up located on opposite sides of the sheet metal parts to be joined. It is also accomplished in part by employing the oscillation piercing technique that advantageously reduces the force transmitted to the robotic arm and the programmable positioning fixture or other support structures.

These and other features of the present invention are discussed in greater detail in the section below titled DESCRIPTION OF THE PREFFERED EMBODIMENT(S).

BRIEF DESCRIPTION OF THE DRAWINGS

A preferred embodiment of the present invention is described in detail below with reference to the attached drawing figures, wherein.

DESCRIPTION OF THE PREFERRED EMBODIMENT

With reference to the figures, a system and method is herein described, shown, and otherwise disclosed in accordance with the preferred embodiment of the present invention. Broadly, the present invention provides a system and method for improved programmable pogo self-piercing riveting which is better suited for use in such applications as vehicle assembly, particularly robotic applications in vehicle assembly. It should be understood and appreciated that the broad concept of self-piercing riveting is known in the prior art, as is the design and construction of robots for use in vehicle assembly, and therefore the present disclosure focuses primarily on the improvements provided by the present invention rather than on ancillary details of the overall system into which these improvements might be incorporated.

Figure 1:
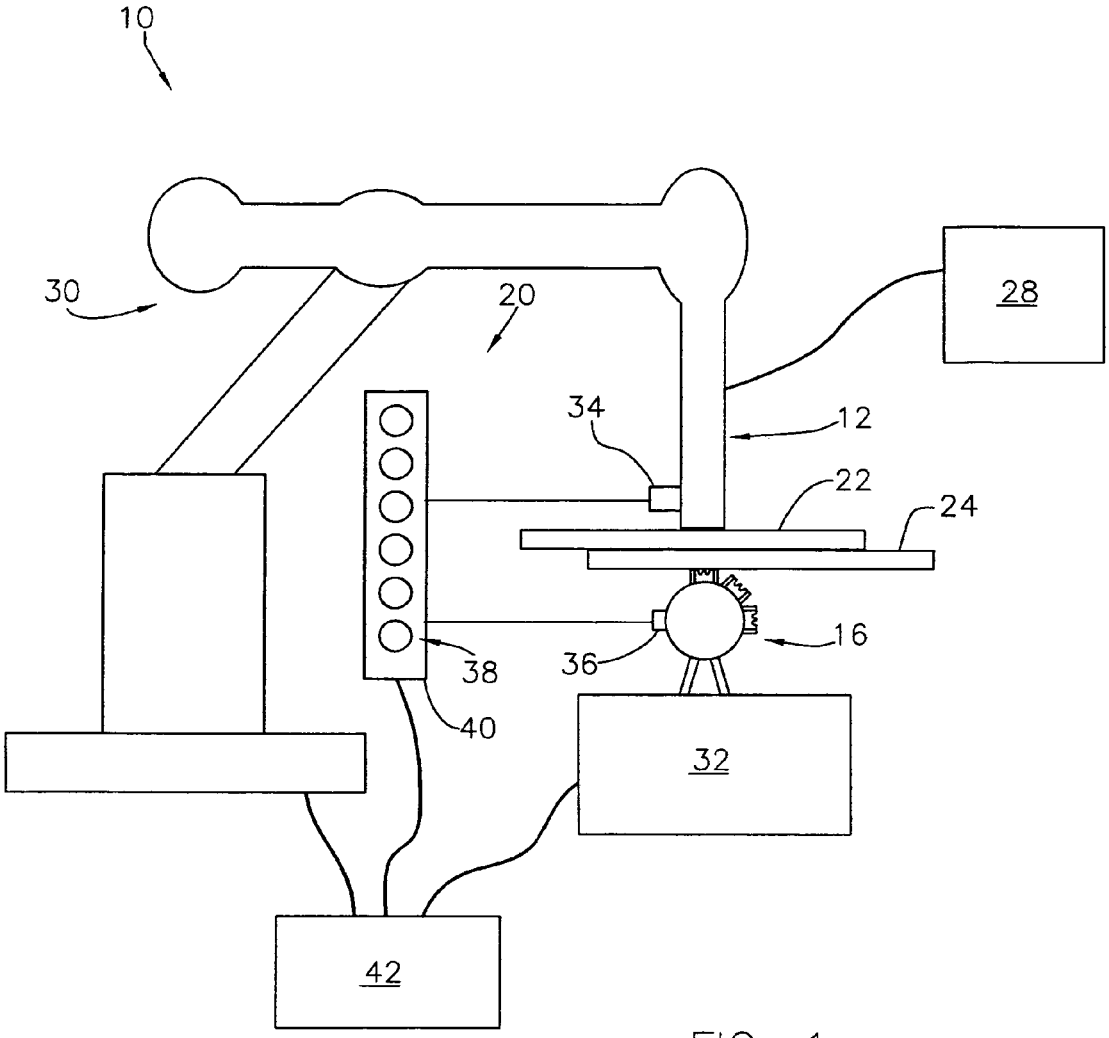
FIG. 1 is high-level depiction of a preferred embodiment of the system of the present invention.
Figure 2:
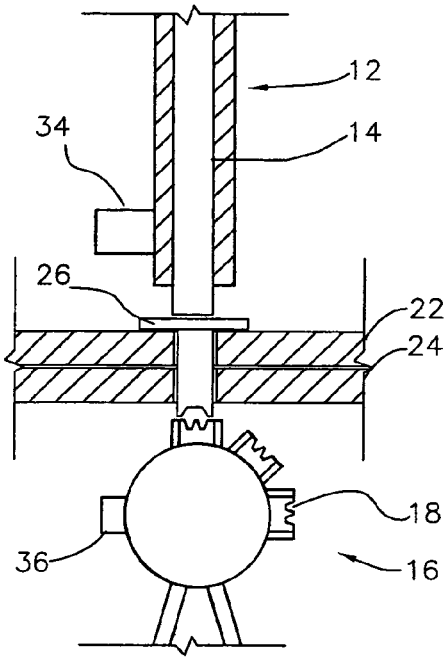
FIG. 2 is a more detailed depiction of a rivet gun component and a back-up component of the system of FIG. 1.

Referring to FIGS. 1 and 2, the system 10 broadly comprises a rivet gun 12 including a punch 14; a movable single back-up 16 including a plurality of dies 18; and an alignment subsystem 20.

The rivet gun 12 contacts a first outward side of aligned first and second sheet metal parts 22,24, receives a self-piercing rivet 26 from an associated hopper 28, and, using the punch 14, drives the rivet 26 through the aligned sheet metal parts 22,24. The rivet gun 12 may be any substantially conventional rivet gun, such as, for example, a single-point servo rivet gun carried by a robotic arm 30 which is adapted and operable to position and re-position the rivet gun in a conventional "pogo" manner based on pre-programmed instructions.

The back-up 16 positions a selected one of the plurality of dies 18 to contact a second outward side of the aligned first and second sheet metal parts 22,24 at a location which is substantially directly opposite the contact point of the rivet gun 12, and both provides a support to facilitate the rivet gun 12 driving the rivet 26 and shapes the projecting shank or end of the fully-penetrated rivet 26 to securely fasten the first and second sheet metal parts 22,24 together. The availability of multiple dies 18 increases accessibility and efficiency. The back-up 16 may be carried by any suitable support structure, such as, for example, a programmable positioning fixture 32 which is adapted and operable to position and re-position the back-up in the aforementioned conventional "pogo" manner based on pre-programmed instructions.

The alignment subsystem 20 facilitates aligning the rivet gun 12 and back-up 16 opposingly on the outward sides of the aligned first and second sheet metal parts 22,24, such that the contact point of the rivet gun 12 is substantially directly opposite the contact point of the selected die. The alignment subsystem 20 includes first and second emitters 34,36 and a plurality of sensors 38.

The first and second emitters 34,36 are preferably laser-emitting diodes. The first laser-emitting diode 34 is coupled with the rivet gun 12, and the second laser-emitting diode 36 is coupled with the back-up 16. Both diodes 34,36 emit coherent electromagnetic radiation at least in the direction of the sensors 38. Alternatively, other forms of emitters and emissions may be used as desired, including, for example, normal (incoherent) light emitters, ultrasonic emitters; infrared emitters; or RF emitters.

Figure 4:
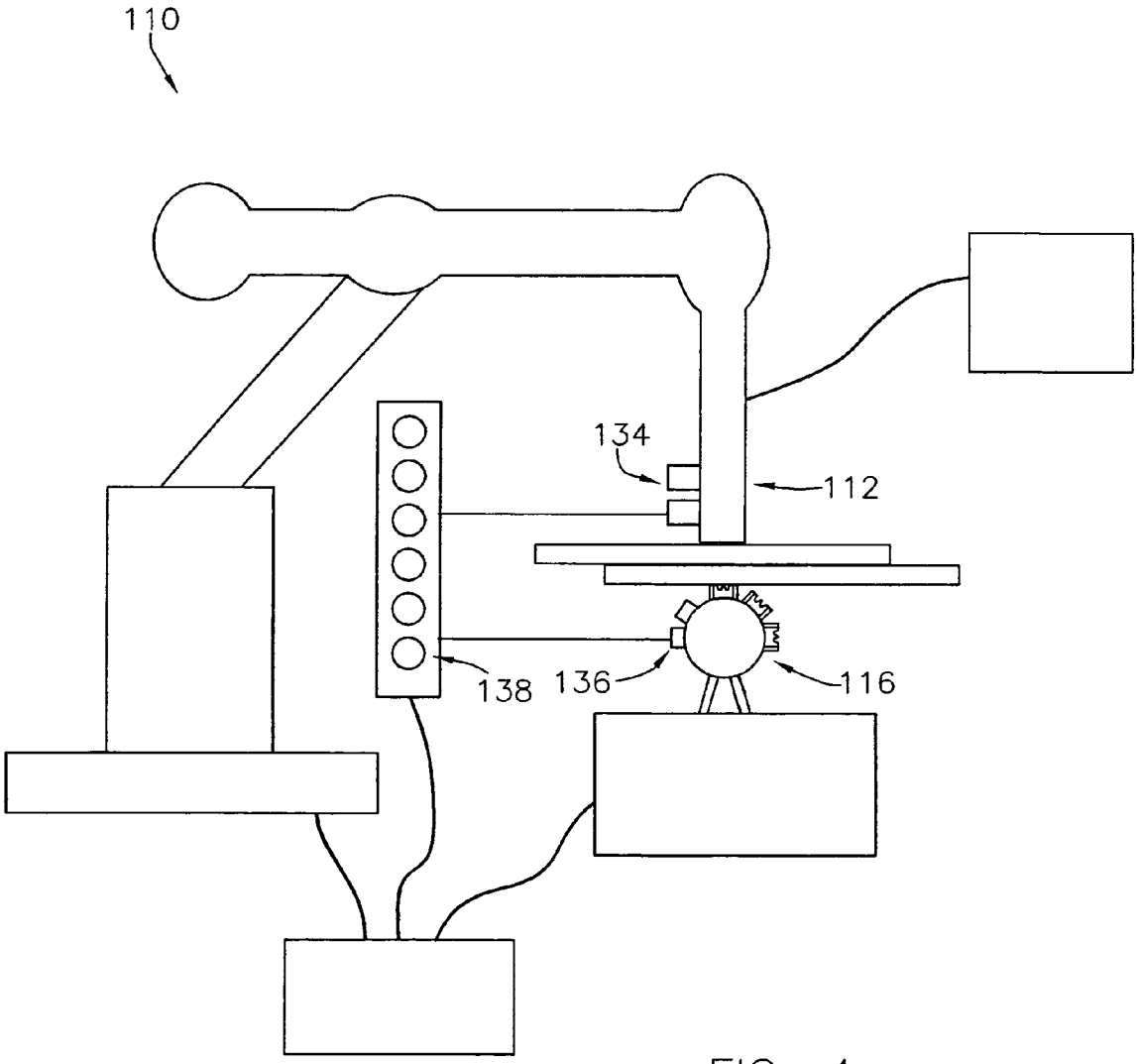
FIG. 4 is a high-level depiction of a preferred alternative embodiment of the system of the present invention.

Referring to FIG. 4, in an alternative embodiment of the system 110 is shown wherein there are provided multiple first emitters 134 associated with the rivet gun 112, and multiple second emitters 136 associated with the back-up 116. The multiple emitters 134,136 allow for stereoscopic detection and positional triangulation which provides more accurate measurements between the sensors 138 and the emitters 134, 136.

The plurality of sensors 38 are supported by and arrayed on a stand or arm 40, connected to a controller 42 associated with the robotic arm 30 and the programmable positioning fixture 32, and operable to detect the emissions of the diodes 34,36. The stand or arm 40 may be appropriately adjustable to better position the sensors 38 for receiving the emissions. Based on the particular sensors of the plurality of sensors 38 detecting the emissions, or how or from which direction the sensors detect the emissions, a feedback signal is transmitted to the controller 42 for adjusting, or causing the robotic arm 30 or the programmable positioning fixture 32 to adjust, as appropriate, the position of either or both of the rivet gun 12 or the back-up 16 so as to achieve better alignment. The number and nature of the sensors 38 may vary for any given application, and may depend on such factors as the sensing capabilities of the individual sensors and the desired degree of precision in aligning the rivet gun 12 and the back-up 16.

In one contemplated embodiment, for example, the sensors 38 take the form of one or more cameras, and the emitters 36,38 take the form of either active emitters of any form of electromagnetic radiation (e.g., visible light, infrared radiation) that is detectable by the camera, or passive reflectors that merely reflect such electromagnetic radiation which is provided by a separate active emitting device (not shown). This separate device may be positioned substantially adjacent to the camera so as to facilitate the camera receiving the reflected radiation.

Figure 3:
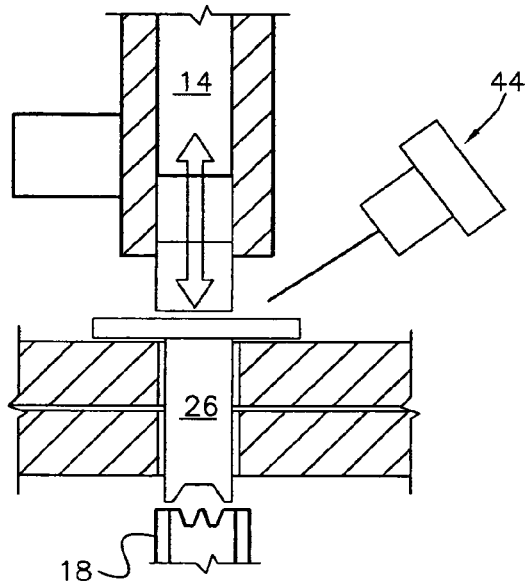
FIG. 3 is a depiction of a punch component and a die component shown in FIG. 2 employing an oscillation piercing technique of the present invention.

Referring also to FIG. 3, because robotic support structures, such as the robotic arm 30 and the programmable positioning fixture 32, have payload limits, the present invention preferably uses an oscillation piercing technique wherein the punch 14 is driven in an oscillating manner to effectively hammer the rivet 26 into and through the aligned first and second sheet metal parts 22,24. A portion of the dynamic forces associated with this process are absorbed by the inertias of the punch 14 and the back-up 16, such that only a force of significantly reduced magnitude is transmitted to the robotic arm 30 and the programmable positioning fixture 32. This reduction in force allows for use of programmable pogo SPR for vehicle body assembly without exceeding the static force limits of typical robotic arms or fixtures. It will be understood and appreciated that the force applied during each oscillation and the frequency of oscillation may vary for any given application, and may depend on such factors as the percentage of force transferred to the robotic or other support structures; the maximum amount of force endurable by those components; and the thickness, composition, and other properties of the sheet metal parts to be penetrated. It is contemplated, however, that the force applied during each oscillation must be such that the amount of force transferred to the robotic or other support structures does not exceed their static force limits, and that the oscillation frequency will likely be approximately between 0.5 Hz and 30 Hz for most applications.

It is also contemplated that heat may be applied to metal parts 22,24 at the point through which the rivet 26 is to be driven in order to soften the metal and make driving the rivet 26 easier. It will be appreciated that softening the metal in this manner reduces the amount of force needed to drive the rivet 26, and thereby reduces the amount of force that might be transmitted to the support structures. The heat may be applied to either or both of the metal parts 24,26. Such heating may be accomplished by a heating device 44 using any appropriate heating technology, such as, for example, laser heating or resistance heating.

Contemplated useful applications of the present invention include, but are not limited to, vehicle assembly, particularly vehicle underbody assembly, or, more generally, substantially any medium to large-scale operation involving the joining of sheet metal using an SPR process, particularly when performed by robots.

From the preceding discussion it will be understood and appreciated that the present invention provides a number of advantages over the prior art, including, for example, improving the robustness of the SPR process, increasing the flexibility of product designs that rely on the SPR process for assembly, and shortening the cycle time of the SPR process. This is accomplished in part by the alignment subsystem which facilitates efficiently and consistently achieving correct alignment of the rivet gun and the back-up located on opposite sides of the sheet metal parts to be joined. It is also accomplished in part by employing the oscillation piercing technique that advantageously reduces the force transmitted to the robotic arm and the programmable positioning fixture or other support structures.

Although the invention has been described with reference to the preferred embodiments illustrated in the drawings, it is noted that equivalents may be employed and substitutions made herein without departing from the scope of the invention as recited in the claims. As mentioned, for example, the improvements provided by the present invention may be incorporated in whole or in part into substantially any SPR system, and need not include or involve the robotic arm, the programmable positioning fixture, or any specific die or rivet.

The invention claimed is:

1. A self-piercing riveting system for piercing and riveting a plurality of workpieces defining first and second opposite surfaces, and promoting proper alignment between a rivet gun and back-up, said system comprising:

a rivet gun for driving a self-piercing rivet at a first point along one of said surfaces;

a first emitter coupled with the rivet gun and operable to emit a first emission towards said one of the surfaces;

a back-up including a die for shaping a projecting end of the driven self-piercing rivet at a second point along the other of said surfaces, and substantially directly opposite the first point;

a second emitter coupled with the back-up and operable to emit a second emission towards said other of said surfaces; and at least one sensor for receiving the first and second emissions and configured to determine the relative positions of the rivet gun and the back-up and whether the second point is substantially directly opposite the first point.

2. The system as set forth in claim 1, wherein the rivet gun is a single point servo rivet gun.

3. The system as set forth in claim 1, wherein the back-up includes a plurality of selectable dies.

4. The system as set forth in claim 1, wherein the first and second emitters are laser-emitting diodes.

5. The system as set forth in claim 1, wherein there are a plurality of first emitters associated with the rivet gun and a plurality of second emitters associated with the back-up in order to provide stereoscopic reception at the sensor.

6. The system as set forth in claim 1, wherein at least one of the rivet gun and the back-up is mounted on a movable support structure, and wherein the movable support structure is automatically moved in response to the determination of the relative positions of the rivet gun and the back-up in order to position the second point substantially directly opposite the first point.

7. The system as set forth in claim 6, wherein the rivet gun and the back-up are both mounted on movable support structures.

8. The system as set forth in claim 6, further including a controller for receiving sensor signals generated by the sensors and, based thereon, determining the relative positions of the rivet gun and the back-up and initiating movement of the movable support structure in order to position the second point substantially directly opposite the first point.

9. The system as set forth in claim 1, wherein the sensor is a camera.

10. The system as set forth in claim 1, further including a heating device for heating one or more of the first point or the second point in order to facilitate driving the self-piercing rivet.

11. A programmable system for performing self-piercing riveting, the system comprising:

a first movable support structure, the movement of which is substantially automatically controlled;

a rivet gun coupled with the first movable support structure and operable to drive a self-piercing rivet at a first point;

a first laser-emitting diode coupled with the rivet gun and operable to emit a first laser emission;

a second movable support structure, the movement of which is substantially automatically controlled;

a back-up including a die coupled with the second movable support structure and operable to shape a projecting end of the driven self-piercing rivet at a second point which is substantially directly opposite the first point;

a second laser-emitting diode coupled with the back-up and operable to emit a second laser emission;

a plurality of sensors for receiving the first and second laser emissions and for generating sensor signals corresponding thereto; and a controller for receiving sensor signals generated by the sensors and, based thereon, determining the relative positions of the rivet gun and the back-up and therefore whether the second point is substantially directly opposite the first point, and for controlling the movement of the first and second movable support structures in order to position the second point directly opposite the first point.

12. The programmable pogo system as set forth in claim 11, wherein the rivet gun is a single point servo rivet gun.

13. The programmable pogo system as set forth in claim 11, wherein the back-up includes a plurality of selectable dies.

14. The system as set forth in claim 11, wherein there are a plurality of first emitters associated with the rivet gun and a plurality of second emitters associated with the back-up in order to provide stereoscopic reception at the plurality of sensors.

15. The system as set forth in claim 11, further including a heating device for heating one or more of the first point or the second point in order to facilitate driving the self-piercing rivet.

* * * * *